United States Patent [19]

Lowe et al.

[11] Patent Number: 4,912,910

[45] Date of Patent: Apr. 3, 1990

[54] PACKAGE STRUCTURE FOR STORING ARTICLES AND A METHOD AND APPARATUS FOR ACCOMPLISHING THE SAME

[75] Inventors: Byron L. Lowe; Robert T. Lewis, both of Macon, Ga.

[73] Assignee: Brown & Williamson Tobacco Corporation, Louisville, Ky.

[21] Appl. No.: 300,657

[22] Filed: Jan. 23, 1989

[51] Int. Cl.[4] ..... B65B 19/20

[52] U.S. Cl. ..... 53/429; 53/157; 53/474; 493/353; 493/463; 493/967; 206/814

[58] Field of Search ..... 493/353, 463, 967, 360, 493/359, 357, 356; 53/157; 156, 155, 171, 170, 429, 410, 472, 474; 206/814, 268, 269, 270, 271

[56] References Cited

U.S. PATENT DOCUMENTS

| | | | |
|---|---|---|---|
| 1,200,227 | 10/1916 | Pantazi | 53/157 X |
| 3,552,735 | 1/1971 | Felstehausen | 493/463 X |
| 3,762,126 | 10/1973 | Court | 53/157 X |
| 4,073,485 | 2/1978 | Gregoire et al. | 493/353 |
| 4,113,243 | 9/1978 | Gregoire et al. | 493/353 X |
| 4,120,443 | 10/1978 | Gardner et al. | 206/814 X |
| 4,132,155 | 1/1979 | Hicks et al. | 493/353 |
| 4,771,882 | 9/1988 | Lowe et al. | 206/271 X |

*Primary Examiner*—James F. Coan

*Attorney, Agent, or Firm*—Charles G. Lamb

[57] ABSTRACT

A unique and novel storage package and method and apparatus for making the same wherein differences in dimension between the outer receptacle and a package stored therein are compensated by a unique corrugated spacer to provide snug storage, such as in the packaging of cigarette packs.

25 Claims, 4 Drawing Sheets

PACKAGE STRUCTURE FOR STORING ARTICLES AND A METHOD AND APPARATUS FOR ACCOMPLISHING THE SAME

BACKGROUND OF THE INVENTION

The present invention relates to storage packaging and more particularly to a storage package and a method and apparatus of making the same wherein differences in dimension between the outer receptacle and the package to be stored therein are compensated to provide snug storage such as in the packaging of foil-wrapped cigarettes.

It is well known in the art of packaging one or more unit articles in an outer receptacle, such as in the tobacco arts, to utilize spacer members to compensate for dimensional differences between the inner walls of the outer receptacle and the external dimensions of the article or articles to be packaged, attention being directed to U.S. Pat. No. 3,489,272 issued to S. Rosen on Jan. 13, 1970, and to U.S. Pat. No. 3,752,308, issued to C. J. Begemann on Aug. 14, 1973, both of which disclose cartons of cigarettes in which panel spacer members are inserted to compensate for smaller packs to be enclosed within standard-sized cartons. It also is well known in the packaging art to generally assemble at least two stacked items in the same outer receptacle, such as in the cigarette packing machine disclosed by the long-expired U.S. Pat. No. 1,200,227, issued to D. Pantazi on Oct. 3, 1916, in which a coupon or ticket is assembled with a plurality of cigarettes in a pack, and to the more recent U.S. Pat. No. 3,762,126, issued to W. M. Court on Oct. 7, 1973, which relates to an article feeder for a packaging machine in which a leaflet is inserted into an open-ended carton of articles before closing the carton. Further, it is generally well known to cut and corrugate strips of material from a sheet of paper material, attention being directed to U.S. Pat. No. 4,132,155, issued to A. A. Hicks on Jan. 2, 1979. Moreover, it is generally well known to utilize rotary knives to cut continuous sheet materials and to utilize rotary wheels to feed or draw such materials, attention being directed to the two U.S. Pat. Nos. 4,073,485 and 4,113,243, issued to C. G. Gregoire et. al. on Feb. 14, 1978, and Sept. 12, 1978, respectively.

In accordance with the present invention, an efficient, straightforward, comparatively light and inexpensive to manufacture and assemble package structure for storing articles is provided, the inventive structure being particularly suitable for snugly storing foil-wrapped packages of a conventional count of thinner than normal cigarettes in standard-size cigarette packs. In addition, the present invention provides an efficient, straightforward, and comparatively inexpensive method of manufacturing and assembling such package structure with a minimum of steps, as well as an efficiently powered and operative apparatus which can be utilized in accomplishing the inventive method.

Various other advantageous features of the inventive package structure method and apparatus disclosed herein will become obvious to one skilled in the art upon reading the disclosure set forth herein.

SUMMARY OF THE INVENTION

More particularly, the present invention provides a unique and novel package structure for storing articles comprising: an open-ended container preselectively sized and shaped internally to receive the largest of a multiple number of packages, all but one of which have at least one external dimension less than the corresponding co-extending internal dimension of the container; a shaped package disposed in the container preselectively sized and shaped externally with at least one external dimension less than the corresponding co-extending internal dimension of the container; and, at least one corrugated spacer disposed between the inner wall of the receptacle and the package with at least one lesser dimension, the corrugation of the spacer providing a spacer depth equivalent to the at least one differing dimension between the package and the receptacle whereby the assembled package and spacer are snugly disposed within the inner surrounding wall of the receptacle. In addition, the present invention provides a unique and novel method of snugly assembling a package member into an open-ended container having at least one internal dimension thereof greater than a co-extending external dimension of the packaged member comprising: passing a sheet of material of preselected thickness and width from a supply zone to a forming zone; shaping the sheet of material in the forming zone to a preselected breadth equivalent to the difference between the differing internal and external co-extending dimensions and to an appropriate preselected perimeter to provide a shaped spacer sheet dimensioned to permit insertion thereof into the open-ended container; passing the shaped spacer sheet from the forming zone to an assembly zone to assemble the spacer sheet in stacked relation with the package member so that the overall external dimensions of the assembled packaged member and shaped sheet are such that the assembly can be inserted into the open-ended container in snug relation with the internal walls thereof; and, inserting the so-assembled package member and stacked shaped sheet into the open-ended container. Further, the present invention provides a unique and novel apparatus for forming corrugated spacer sheets from a continuous sheet of thin, pliable material comprising: support frame means; corrugation means mounted on the support frame means to corrugate the continuous sheet of material with corrugations of a preselected breadth; cut-off means mounted on the support frame means in preselected, spaced, downstream relation from the corrugation means to sever the continuous sheet material into preselectively sized corrugated spacer sheets; takeoff means mounted on the support frame means in preselected, spaced downstream relation from the cut-off means to take off the spacer sheets for further assembly operations; and, power train means connecting the corrugating means, the cut-off means and the take-off means to drive and feed the sheet material therethrough in synchronous operation. Moreover, the present invention provides structure for storing, guiding and changing the direction of movement of the material as it passes from the inlet to the outlet ends of the novel apparatus.

It is to be understood that various changes can be made by one skilled in the art in one or more of the several steps of the novel method described herein and in one or more of the several parts of the novel manufacturing machine and article structure also described herein without departing from the scope or spirit of the present invention.

BRIEF DESCRIPTION OF THE DRAWINGS

Referring to the drawings which disclose advantageous embodiments of the inventive manufacturing apparatus used in carrying out the inventive method and an inventive article structure.

DETAILED DESCRIPTION OF THE INVENTION

Figure 1:
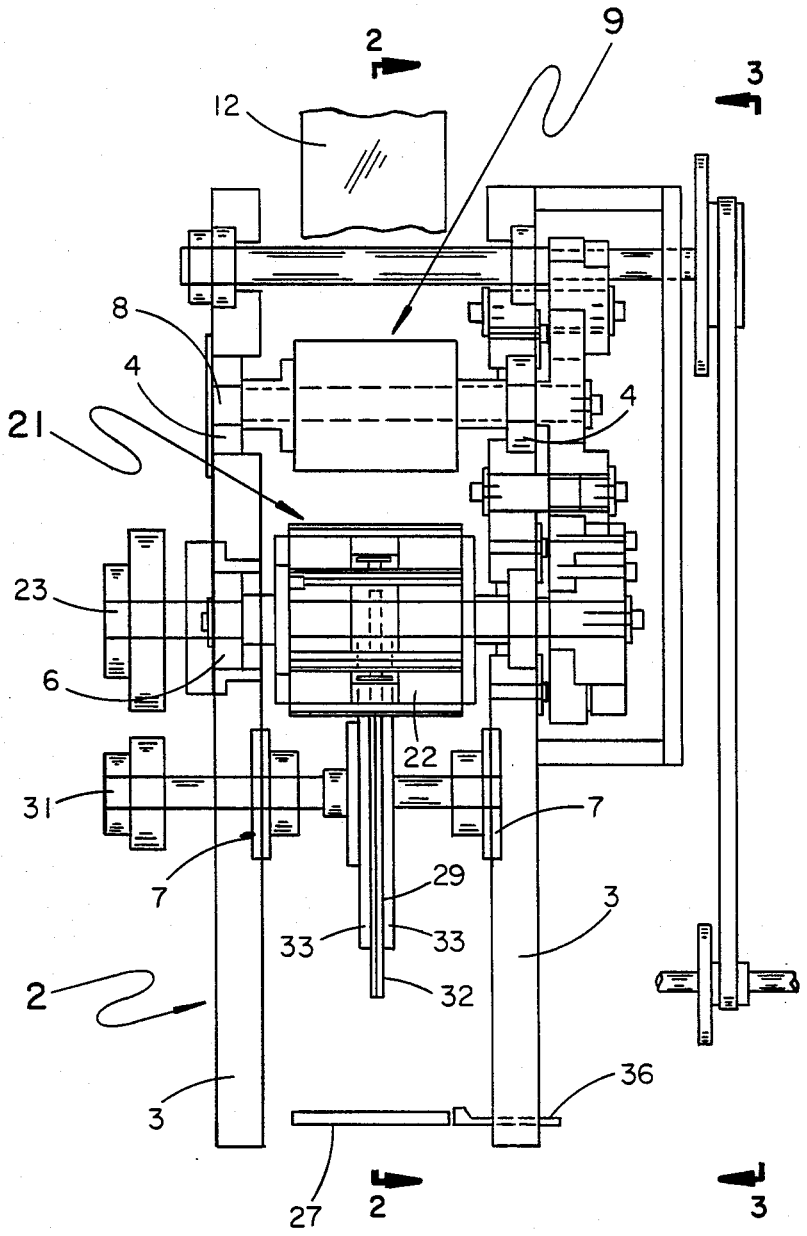
FIG. 1 is a front elevational view of the inventive manufacturing apparatus, partially in schematic form.
Figure 2:
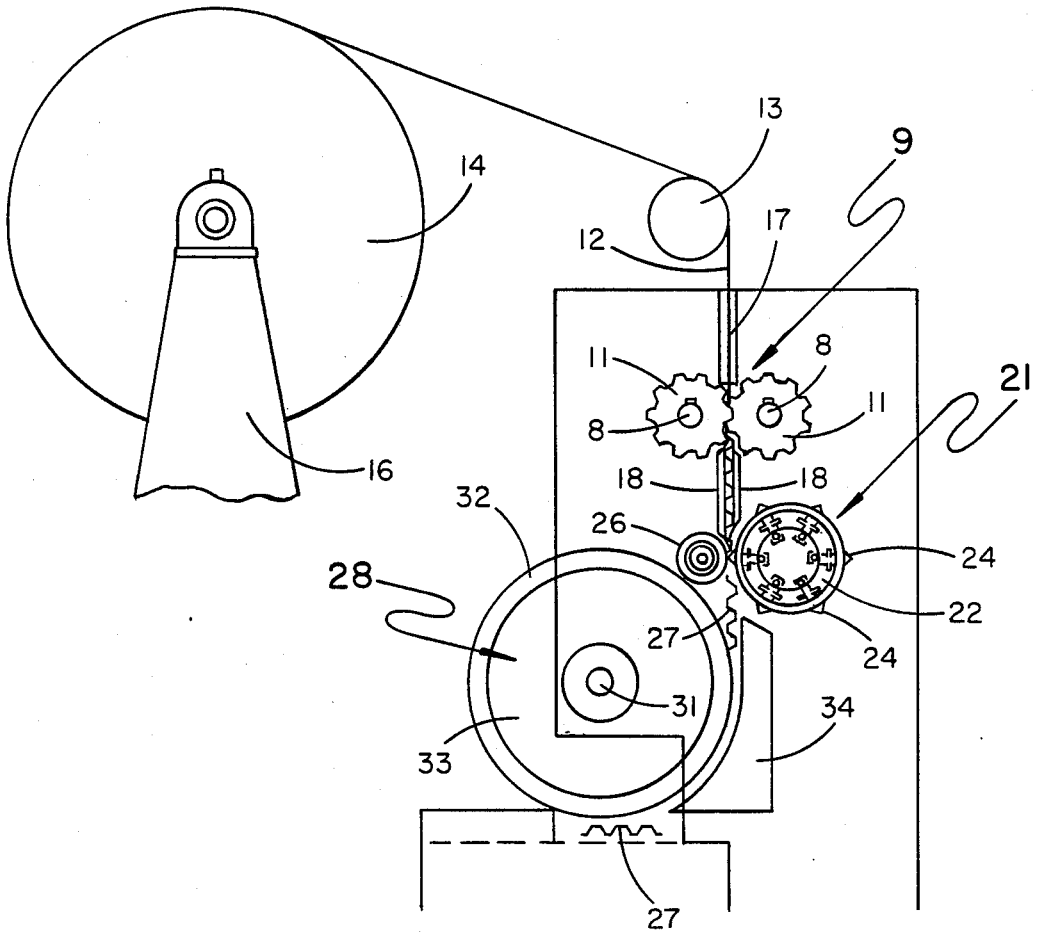
FIG. 2 is a cross-sectional side view taken through plane 2—2 of the apparatus of FIG. 1, disclosing schematically additional features not shown in FIG. 1.
Figure 3:
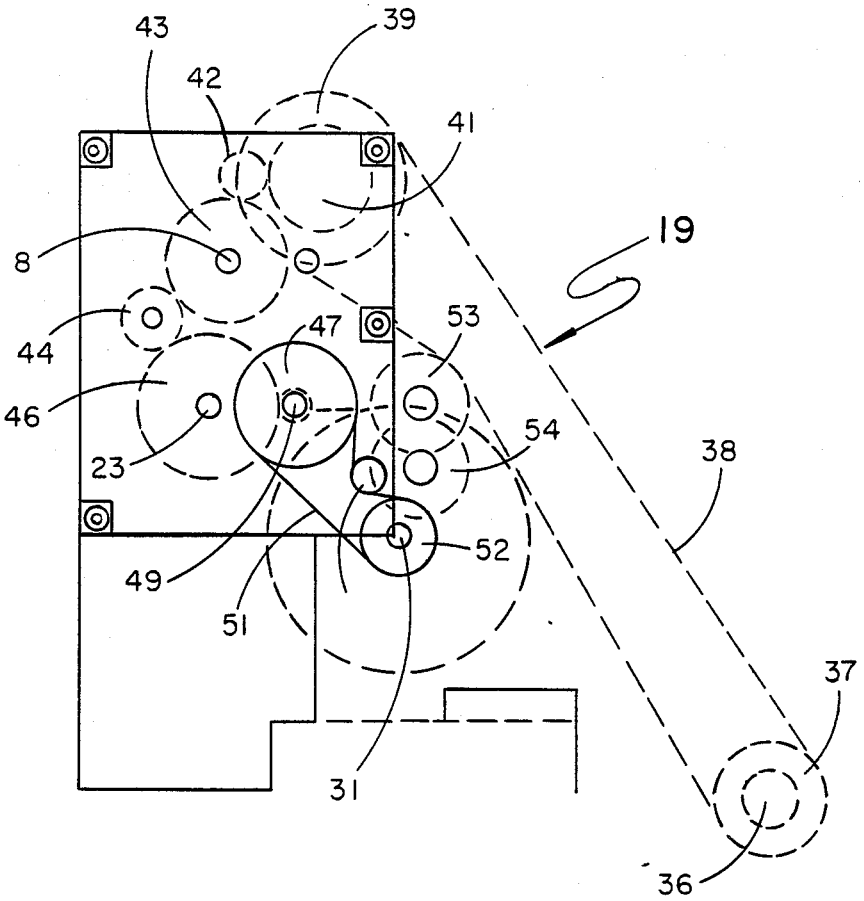
FIG. 3 is a cross-sectional side view taken through plane 3—3 of the apparatus of FIG. 1, also disclosing additional features not shown in FIG. 1.
Figure 5:
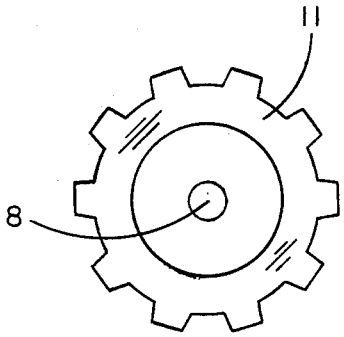
FIG. 5 is an end view of the corrugating roller of FIG. 4.
Figure 4:
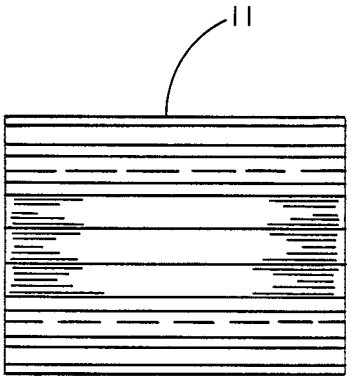
FIG. 4 is an enlarged front view of a corrugating roller as used in the machine of FIGS. 1–3.

Referring to FIGS. 1–5 of the drawings which disclose several views of the apparatus for forming corrugated spacer sheets from a continuous sheet of suitably thin, pliable material such as paper card stock, FIG. 1 discloses a support frame means 2 in the form of a plurality of spaced uprights 3 in which are mounted vertically and selectively spaced sets of bearing blocks 4, midstream bearing blocks 6 and downstream bearing blocks 7. The upstream bearing blocks of set 4 serve to rotatably receive a pair of horizontally spaced shafts 8 (FIG. 2) which support corrugation means 9 in the form of a pair of intermeshing corrugating rollers 11 rotatably mounted thereon with their spaced axes extending horizontally to receive a suitably preselected thin sheet of pliable stock 12, such as paper card stock, which is passed over idler roll 13 from a roll 14 of such paper stock which is rotatably supported on upstream spaced vertically extending standards 16. The idler roll 13 serves to guide the sheet material 12, changing the direction of movement thereof from a substantially horizontal plane to a vertical plane where it is passed through vertically extending spaced upstream guide members 17, which are suitably spaced to permit flat sheet 12 to pass therethrough, corrugated horizontally by intermeshing corrugating rollers 11 and subsequently passed through adjacent downstream vertically extending guide members 18 which are suitably spaced to permit the now-corrugated sheet 12 to pass therethrough. As will be described more fully hereinafter, sheet 12 is drawn from supply roll 14 over idler roll 13 by the corrugation rollers which are driven through a power train 19 (FIG. 3). Further, the corrugation rollers 11 are designed to form corrugations in the sheet material of a preselected depth or breadth for reasons also described hereinafter.

Referring again to FIG. 2, it can be seen that the suitably corrugated sheet 12 passes through spaced vertical guides 18 into a cut-off means 21 in the form of a rotary knife 22 mounted on horizontally extending shaft 23, rotatably supported on vertical standards 3 of support frame 2 by spaced bearing blocks 6. Rotary knife 22 includes a set of six equally spaced knives 24 extending around the periphery thereof to engage with steel back-up or platten roller 26 which also is horizontally and rotatably mounted on support frame in an appropriately spaced position relative horizontally extending rotary knife 22 to allow corrugated sheet material 12 to pass therebetween with knives 24 serving to cut corrugated sheet material 12 of selected length at appropriately spaced intervals to form corrugated spacer sheets 27 of a desired preselected size.

Once a sheet 12 is cut to length to form corrugated spacer sheet 27 by the aforedescribed cut-off means 21, a take-off means 28 mounted on support means 2 in preselected, spaced downstream relation from cut-off means 21 serves to take off corrugated spacer sheet 27 for further assembly operations. Take-off means 28 includes a rotary wheel 29 mounted on rotatably mounted, horizontally extending shaft 31 which is rotatably supported on the vertical standards 3 by the downstream bearing block 7 aforedescribed. Rotary wheel 29 includes a flexible, peripheral blade 32, which can be of a suitable rubber or flexible plastic material, mounted and gripped by spaced rotary side plates 33 which are mounted to rotary shaft 31. Spaced from and cooperatively positioned relative flexible blade 32 is curved guide member 34. Guide member 34 cooperates with blade 32 to reorient a corrugated spacer sheet 27 from a vertical to a horizontal position. At this point, a packer lug 35 (FIG. 1) is actuated by suitably synchronous mechanism (not shown) to move spacer 27 to a further assembly operation where it is assembled with a wrapped package and inserted into a container, as will be described more fully hereinafter.

Referring particularly to FIGS. 1 and 3 of the drawings, it can be seen that aforedescribed power train means 19 which drives and feeds sheet material 12, connects corrugating means 9 in the form of spaced corrugating rollers 11; cut-off means 21 in the form of rotary knife 22, knives 24 and back-up roller 26; and, take-off means 28 in the form of rotary take-off wheel 29 and flexible gripping blade 32 by a suitable gear and belt assembly mounted on support frame 2 to drive and feed the sheet material in synchronous operation. Any one of a number of suitable power drives can be employed and so timed in synchronous operation to make a corrugated spacer of preselected size, and in the embodiment of FIG. 3 a suitable drive 19 and appropriately sized gears, belts and idlers connecting the several aforedescribed shafts 8, 23 and 31 is disclosed as belt connected to a main drive source 36.

In this regard, and in a typical example, main drive source 36 (FIG. 3) can be connected to an 18-tooth sprocket 37 to move the sprocket at 100 RPM. Sprocket 37, in turn, is connected by belt 38 to a 27-tooth sprocket 39 which is driven at 66.6 RPM to drive a 48-tooth gear 41 also at 66.6 RPM. Gear 41, through idler gear 42, drives a 64-tooth gear 43 connected to the corrugating roller shaft 8 at 18.75 RPM. Gear 43, in turn, through idler gear 44, drives a 72-tooth knife gear 46 mounted on shaft 23 at 16.5 RPM. Knife gear 46, in turn, is connected to a 32-tooth timing gear 47 driven at 74 RPM. The shaft 49 for steel back-up roller 26 is connected to timing gear 47 to be driven through a 16-tooth gear also at 74 RPM. A belt 51 connects gear 47 through sprocket 52 on shaft 31 to drive the take-off wheel 32 at 100 RPM. Suitable take-up sprockets 53, 54, and 56 are utilized in engagement with belts 38 and 51 respectively to adjust belt tension properly. It is to be understood that any one of a number of other type drive assemblies can be used besides that described herein without departing from the disclosed invention.

Figure 6:
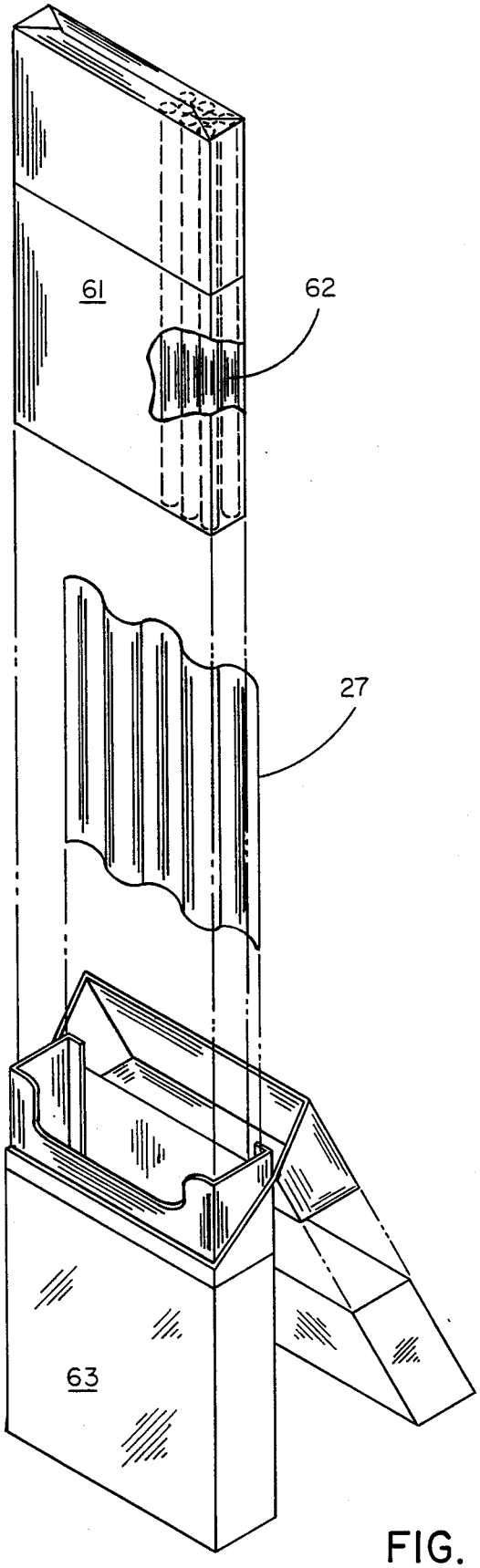
FIG. 6 is an exploded view of a novel article structure including a corrugated spacer sheet incorporated as part of a cigarette pack.

In accordance with a further feature of the present invention, the above-described inventive apparatus can be employed in a novel method of snugly assembling a package member, which can be in the form of a foil-wrapped rectangular package 61 of thin cigarettes 62 as disclosed in FIG. 6 of the drawings, into an open-ended container such as the open-ended cardboard container or pack of rectangular shape 63, as also disclosed in FIG. 6. Cigarette container 63, as disclosed, is one having conventional internal length, width and breadth dimensions, so as to accommodate a foil-wrapped package of regular or conventional cigarettes which would snugly fit into container 63. In the embodiment disclosed, foil-wrapped rectangular package 61 is of thin cigarettes 62 with an external length and breadth equivalent to the internal width and breadth of container or pack 63. However, the internal breadth of container 63 is greater than the breadth of foil-wrapped rectangular package 61 and, as a consequence, the package 61 would not be in snug relation with pack 63 when inserted therein. To accommodate for this and pursuant to the present invention, a suitable sheet of material such as card stock is stored as a roll 14 in a supply zone where it is supported by the spaced standards 16. This sheet of material is carefully sized in width so that such width dimension provides spacer 27, described hereinafter having a length after shaping less than the internal length of container 63 so as to minimize the amount and weight of spacer material required but at the same time being of a length sufficient to insure spacer stability. The sheet of material 12 is drawn in a horizontal plane over idler roll 13 downwardly in a vertical direction through spaced upstream guides 17 and by and through the corrugating means 9 of a forming zone where the sheet is corrugated by intermeshing corrugating rollers 11 with corrugations extending horizontally and normally to the vertical line or direction of movement of sheet 12. In this regard, the corrugations by rollers 11 are of a breadth equivalent to the difference between the breadth of the wrapped rectangular package of cigarettes 62 and the internal breadth of container 63. The corrugated sheet 12 is then passed downwardly in the same vertical plane through spaced downstream guide members to cut-off zone where the sheet is cut by cut-off means 21 into spacer sheets 27 which, when oriented through 90° with corrugations extending lengthwise and assembled with the foiled package 61 have a width equivalent to the internal width of container 63 and the external width of package 61. Each corrugated spacer 27 is passed to a take-off zone through friction grip and guide means in the form of take-off wheel 29 and curved guide 34, the plane of orientation of spacer 27 again being changed, this time from vertical to horizontal. The spacer 27 is then passed to any one of several types of known assembly zones (details of which are not disclosed) where it is stacked with a wrapped cigarette pack 61 with its corrugations extending along the length of the package and the width of spacer sheet 12 being co-extensive with package 61. A suitable tacking adhesive is applied at spaced points along corrugated spacer 27 to avoid collapse at the corrugations and on the foil wrapper of package 61 and the assembled and stacked spacer 27 and cigarette package 61 are inserted into container 63 to snugly fit therewith with the adhesive tacking agent adhering to the adjacent inner walls of container 63 to insure the snug supporting stability of the corrugated spacer sheet 27.

Thus, in accordance with the above-described novel method and apparatus, a novel package structure for storing thin cigarettes in a conventional pack is provided including, as shown in FIG. 6 of the drawing, an open-ended stiff paper pack or container 63 of rectangular shape with preselectively conventionally sized internal length, width and breadth dimensions. Disposed within container 63 is a stack assembly including a rectangular package 61 of foil-wrapped, thin cigarettes 62, the package 61 having external length and width dimensions equivalent to the internal length and width of container or pack 63 but, because of the nature of the thin cigarettes, a breadth less than the internal breadth of container 63. To compensate for this difference in breadth, corrugated paper card stock spacer 27 is provided as part of the stacked assembly to be disposed between a inner face wall of pack 63 and an external face wall of foil-wrapped package 61. The width of spacer 27 is equivalent to the internal width of pack 63 and the external width of package 61. The length of spacer 27 is less than the equivalent lengths of the pack 63 and package 61, and the breadth of the spacer is equivalent to the difference in breadth between pack or container 63 and package 61. Thus, the assembled package of spacer 27 and package 61 fits snugly within pack 63 with corrugations extending along the pack and a portion of the package length. As above discussed, to add to the stability of the overall structure during consumer usage, both spacer 27 and foil-wrapped package 61 are adhesively tacked at preselected spaced points to the opposed inner face walls of pack 63.

The invention claimed is:

1. A method of snugly assembling a packaged member into an open-ended container having at least one internal dimension thereof greater than a co-extending external dimension of said packaged member comprising:

passing a sheet of material of preselected thickness and width from a supply zone to a forming zone;

shaping said sheet of material in said forming zone to a preselected breadth equivalent to the difference between said differing internal and external co-extending dimensions and to appropriate preselected perimeter to provide a shaped spacer sheet dimensioned to permit insertion thereof into said open-end container;

passing said shaped spacer sheet from said forming zone to an assembly zone to assemble said spacer sheet in stacked relation with said package member so that the overall external dimensions of said assembled packaged member and shaped sheet are such that said assembly can be inserted into said open-ended container in snug relation with the internal walls thereof; and, inserting said assembled package member and stacked shaped sheet into said open-ended container.

2. The method of assembling a package of claim 1, wherein said sheet is shaped in said forming zone by corrugation and cutting steps.

3. The method of assembling a package of claim 1, wherein said sheet is shaped in said forming zone by respectively successive corrugation and cutting steps.

4. The method of assembling a package of claim 1, wherein said sheet of material is passed vertically through said forming zone and horizontally through said assembly zone.

5. The method of assembling a package of claim 1, wherein said sheet of material is drawn from said supply zone through said forming zone.

6. The method of assembling a package of claim 1, wherein said sheet of material is drawn from said supply zone through said forming zone by a corrugation step to be subsequently passed to a cutting zone to provide said shaped spacer sheet with appropriate dimensions to permit insertion into said open-ended container.

7. The method of assembling a package of claim 1, wherein said shaped spacer sheet of material is passed from said forming zone to said assembly zone through a friction grip and guide means which changes the plane of orientation of said shaped spacer sheet.

8. The method of assembling a package of claim 1, wherein said sheet of material in said supply zone is in roll form with a preselected width of a dimension which provides a preselected dimension after shaping not greater than the corresponding internal dimension of said open-ended container.

9. The method of assembling a package of claim 1, wherein said sheet of material in said supply zone is of paper card stock.

10. The method of assembling a package of claim 1, wherein said open-ended container is of rectangular shape with internal length and width dimensions thereof equivalent to the external length and width dimensions of said packaged member and with the breadth thereof greater than the breadth of said packaged member, whereby said assembled package member and said shaped spacer sheet of preselected breadth fit snugly into said open-ended container after insertion of said assembly therein.

11. The method of assembling a package of claim 1, and tacking said shaped sheet at spaced points thereon to the adjacent inner wall of said open-ended container to ensure the supporting stability thereof.

12. A method of assembling a wrapped rectangular package of cigarettes into an open-ended cardboard paper container of rectangular shape having internal length and width dimensions equivalent to the external length and width dimensions of said wrapped cigarette package, said container having a breadth greater than the breadth of said wrapped rectangular package of cigarettes comprising:

storing a sheet of card stock material in roll form in a supply zone, said sheet of material having a preselected width of a dimension which provides a preselected length after shaping less than the internal length of said container;

drawing said sheet of card stock material in a horizontal plane over an idler roll downwardly in a vertical plane by and through a corrugating means in a forming zone to corrugate said sheet with corrugations extending horizontally and normally to the vertical line of movement of said sheet, said corrugations being of a breadth equivalent to the difference between said external breadth of said wrapped rectangular package of cigarettes and the internal breadth of said container;

passing said corrugated sheet downwardly in a vertical plane to cut said corrugated sheet into corrugated spacer sheets of preselected width equivalent to the internal width of said rectangular container;

passing each of said shaped corrugated spacer sheets of preselected length, width and breadth through a friction grip and guide means to change the plane of orientation of said sheet to horizontal to be passed from said forming zone to an assembly zone;

stacking each of said corrugated spacer sheets with a wrapped cigarette package with the corrugations extending along the length of said package and the width of said spacer sheet coextensive with the width of said cigarette package;

applying a suitable adhesive tacking agent at spaced points along said spacer sheet; and, inserting said assembled and stacked spacer sheet and cigarette package into said open-ended cardboard container to snugly fit therewith with the adhesive tacking agent adhering to the adjacent inner walls of said container to ensure the snug supporting stability of said corrugated spacer sheet.

13. Apparatus for forming corrugated spacer sheets from a continuous sheet of thin, pliable material comprising:

support frame means;

corrugation means mounted on said support frame means to corrugate said continuous sheet of material with corrugations of a preselected breadth, said corrugation means comprising a pair of intermeshing corrugating rollers which act as drive rollers as they corrugate the sheet material therebetween;

cut-off means mounted on said support frame means in preselected, spaced downstream relation from said corrugation means to sever said continuous sheet material into preselectively sized corrugated spacer sheets;

take-off means mounted on said support frame means in preselected, spaced downstream relation from said cut-off means to take off said spacer sheets for further assembly operations; and, power train means connecting said corrugating means, said cut-off means and said take-off means to drive and feed said sheet material therethrough in synchronous operation.

14. The apparatus of claim 13 and guide means upstream said corrugation means to guide said continuous sheet of material thereto.

15. The apparatus of claim 13 and guide means between said corrugation means and said cut-off means to guide said corrugated continuous sheet of material thereto.

16. The apparatus of claim 13, said take-off means comprising a rotary wheel having a flexible outer periphery and a curved guide member spaced from and extending along a portion of the outer periphery of said flexible outer periphery positioned to engage each corrugated sheet as it is severed by said cut-off means and transport the same to a changed plane of operation for further assembly operations.

17. The apparatus of claim 13, said cut-off means comprising a cooperatively mounted, spaced rotary knife and back-up roller.

18. The apparatus of claim 13, said cut-off means comprising a cooperatively mounted rotary knife having a plurality of cut-off blades mounted in spaced relation around the periphery thereof and a back-up roller cooperating with said spaced cut-off blades.

19. The apparatus of claim 13, said take-off means comprising a rotary wheel having a flexible outer periphery and a spaced guide member positioned to engage each corrugated sheet as it is severed by said cut-off means and transport the same for further assembly operations.

20. A cigarette package structure for storing cigarettes comprising:

an open-ended stiff paper pack of rectangular shape to include preselectively sized internal length, width and breadth dimensions;

a rectangular package of foil-wrapped cigarettes disposed in said pack, said wrapped package of cigarettes having external length and width dimensions equivalent to said internal length and width dimensions of said pack and a breadth less than the internal breadth of said pack; and, a corrugated paper card stock spacer disposed between an inner face wall of said rectangular pack and a face wall of said wrapped package of cigarettes, the width of said spacer being equivalent to the equivalent width of said pack and package, the length of said spacer being less than the length of said equivalent pack and package length, and the breadth of said spacer being equivalent to the difference in breadth between said pack, the corrugations of said spacer extending lengthwise between said pack and package with said spacer and said foil-wrapped package being adhesively tacked at preselected spaced points to the opposed inner face walls of said pack.

21. Apparatus for forming corrugated spacer sheets, each of which is to be inserted into an open-ended rectangular container in assembly with a wrapped rectangular package of cigarettes which has external length and width dimensions equivalent to the internal length and width dimensions of said container and which when assembled with a spacer sheet has an external breadth equivalent to the internal breadth of said open-ended rectangular container, comprising:

a storage frame having spaced standards adapted to support a roll of card stock sheet material in elevated position with the roll axis extending horizontally, said card stock roll having a preselected width of a dimension which provides a preselected length after shaping less than the internal length of said open-ended container;

an idler roll mounted in spaced relation from said storage frame with its axis extending in a horizontal position to receive said cardboard stock material from said storage frame and guide such material from a horizontal to a vertical plane;

a support frame positioned below said idler roll, said support frame having a pair of intermeshing corrugating rollers rotatably mounted thereon with their axes extending horizontally to receive said cardboard stock in sheet form from said idler roll and corrugate the same therebetween;

a pair of vertically extending spaced and aligned upper and lower guide members mounted on said support frame upstream and downstream said corrugating rollers to guide said cardboard stock before and after corrugation by said corrugating rollers;

a rotary knife having a horizontal axis of rotation and a plurality of cut-off blades mounted in spaced relation around the periphery thereof, said rotary knife being mounted on said support frame below said downstream guide to cooperate with a back-up roll horizontally mounted in adjacent relation thereto on said support frame to sever said corrugated continuous sheet of cardboard stock into preselectively sized corrugated spacer sheets;

a rotary take-off wheel and spaced curved guide member mounted on said support frame downstream said rotary knife, said rotary wheel having a flexible outer periphery positioned to frictionally engage each corrugated spacer with the spaced guide member extending along a portion of the flexible outer periphery so as to engage each corrugated sheet as it is severed by said rotary knife and transport the same to a horizontal plane of operation to be moved to an endless carrier for further assembly operations; and, a power train gear and belt assembly mounted on said support frame to connect said corrugating rollers, said rotary knife wheel and back-up roll, and said rotary take-off wheel and curved guide member to drive and feed said sheet material therethrough in synchronous operation.

22. A package structure for storing articles comprising: an open-ended container preselectively sized and shaped internally to receive the largest of a multiple number of packages, all but one of which have at least one external dimension less than the corresponding co-extending internal dimension of the container;

a shaped packaged disposed in said receptacle preselectively sized and shaped externally with at least one external dimension less than the corresponding co-extending internal dimension of said container; and, at least one corrugated spacer disposed between the inner wall of said container and said package with at least one lesser dimension, the corrugation of said spacer providing a spacer depth equivalent to the at least one differing dimension between said package and said container whereby said assembled package and spacer are snugly disposed within the inner surrounding wall of said container, said corrugated spacer being tacked at selected spaced points to the inner wall of said container.

23. The package structure of claim 22, said container and said package disposed therein being of rectangular shape with their respectively internal and external length and width dimensions being equivalent and their respective internal and external breadth dimensions being different and said corrugated spacer, having an equivalent width dimension, a length dimension not exceeding the corresponding length dimension of said internal and external length dimensions of said container and package respectively and a breadth equivalent to the difference between the respective breadths of said internal container and external package.

24. The package structure of claim 22, said container being a stiff, open-ended, paper tobacco pack and said package being a foiled wrapper containing a plurality of smoking articles.

25. The package structure of claim 22, said corrugated spacer being of paper card stock.

* * * * *

UNITED STATES PATENT AND TRADEMARK OFFICE

CERTIFICATE OF CORRECTION

PATENT NO. : 4,912,910

DATED : April 3, 1990

INVENTOR(S) : Lowe/Lewis

It is certified that error appears in the above—identified patent and that said Letters Patent is hereby corrected as shown below:

In column 9, line 20, claim 20, after "pack", insert ---and said package whereby said package fits snugly within said pack---.

Signed and Sealed this

Fifth Day of November, 1991

*Attest:*

HARRY F. MANBECK, JR.

*Attesting Officer*

*Commissioner of Patents and Trademarks*